US009358439B2

(12) United States Patent
Manner et al.

(10) Patent No.: US 9,358,439 B2
(45) Date of Patent: Jun. 7, 2016

(54) RECREATIONAL AMUSEMENT

(71) Applicant: The Tailgate Crew, LLC, San Antonio, TX (US)

(72) Inventors: Kevin Edward Manner, Boerne, TX (US); Brooks Christopher Bennett, Baltimore, MD (US)

( * ) Notice: Subject to any disclaimer, the term of this patent is extended or adjusted under 35 U.S.C. 154(b) by 168 days.

(21) Appl. No.: 14/318,396

(22) Filed: Jun. 27, 2014

(65) Prior Publication Data

US 2014/0315667 A1 Oct. 23, 2014

Related U.S. Application Data

(60) Division of application No. 13/563,436, filed on Jul. 31, 2012, now Pat. No. 8,764,017, which is a continuation of application No. 12/733,323, filed as application No. PCT/US2008/009995 on Aug. 23, 2008, now abandoned, which is a continuation-in-part of application No. 11/895,282, filed on Aug. 23, 2007, now abandoned.

(51) Int. Cl.

| | |
|---|---|
| ***A63B 63/00*** | (2006.01) |
| ***A63B 63/08*** | (2006.01) |
| ***A63F 3/00*** | (2006.01) |
| ***A63B 67/06*** | (2006.01) |
| ***A63B 71/00*** | (2006.01) |
| ***A63F 9/00*** | (2006.01) |
| *A63B 71/02* | (2006.01) |
| *A63B 71/06* | (2006.01) |

(52) U.S. Cl.

CPC ..... *A63B 63/08* (2013.01); *A63B 63/083* (2013.01); *A63B 67/06* (2013.01); *A63B 71/0036* (2013.01); *A63F 3/00533* (2013.01); *A63F 9/001* (2013.01); *A63B 2071/025* (2013.01); *A63B 2071/026* (2013.01); *A63B 2071/0625* (2013.01); *A63B 2209/10* (2013.01); *A63B 2210/50* (2013.01); *A63B 2225/605* (2013.01); *A63B 2225/66* (2013.01); *A63B 2225/682* (2013.01); *A63B 2225/685* (2013.01)

(58) Field of Classification Search

CPC ..... A63B 63/00

USPC ..... 273/398, 400, 402; 62/371, 457.1, 62/457.7

See application file for complete search history.

(56) References Cited

U.S. PATENT DOCUMENTS

| | | | | |
|---|---|---|---|---|
| 4,667,484 | A * | 5/1987 | Tarozzi | A45C 11/20 220/318 |
| 2006/0125186 | A1 * | 6/2006 | Digges, III | A63B 7/06 273/402 |
| 2007/0045964 | A1 * | 3/2007 | Petras | A63B 63/00 273/317 |

* cited by examiner

*Primary Examiner* — James S McClellan

(74) *Attorney, Agent, or Firm* — Wayne J. Colton, Inc.

(57) ABSTRACT

A recreational amusement takes the form a cooler having a toss-type game board integrated with the cooler's lid. The toss-type game board includes one or more cavities in the top of the lid. Provision is made for orienting the top of the lid in a sloping position for play of the game enabled by the game board. The cooler retains all conventional features of a beverage type cooler and, in particular, the characteristic of the interior space of the cooler being substantially sealed off from the environment about the cooler by placement atop the body of the cooler of the lid.

21 Claims, 14 Drawing Sheets

RECREATIONAL AMUSEMENT

RELATED APPLICATIONS

This application claims any and all available priority to and benefit of U.S. patent application Ser. No. 11/895,282 filed on Aug. 23, 2007; P.C.T. international patent application No. PCT/US2008/009995 filed on Aug. 23, 2008 (designating the United States); U.S. patent application Ser. No. 12/733,323 meeting 35 U.S.C. §371(c) on Jul. 6, 2010 (filed on Aug. 23, 2008); and co-pending U.S. patent application Ser. No. 13/563,436 filed Jul. 31, 2012. By this reference, the full disclosures, including the claims and drawings, of U.S. patent application Ser. No. 11/895,282; P.C.T. international patent application No. PCT/US2008/009995; U.S. patent application Ser. No. 12/733,323; and U.S. patent application Ser. No. 13/563,436 are each incorporated herein as though now set forth in their respective entireties.

FIELD OF THE INVENTION

The present invention relates to recreation. More particularly, the invention relates to a recreational amusement specifically adapted to enable convenient transport of a game by integrating elements of the game into a cooler such as would be expected to be brought along to a recreational outing.

BACKGROUND OF THE INVENTION

Few things are as rejuvenating as going on a recreational outing with family or friends. Unfortunately, some of the fun of such outings is often dampened for those assigned the tasks of packing up and transporting food and beverages, picnic wares, sporting equipment and the like. Often, due to a limited space for transportation of such items, those assigned the tasks are often force to make difficult decisions regarding what to take and what to leave behind, often to the disappointment of at least some others.

It is therefore an overriding object of the present invention to eliminate at lease a part of the resulting frustration by providing a recreational amusement that is highly integrated with an otherwise conventional food and beverage cooler, which, of course, is an item rarely omitted from the outing. It is an additional object of the present invention to provide such a recreational amusement that may be utilized in a number of manners, thereby ensuring that those who are fortunate enough to often embark on recreational outings do not quickly bore of the amusement. Still further, it is an object of the present invention to provide such a recreational amusement that is economical to manufacture and easy to play, thereby ensuring the benefit by those of virtually any economic means or age.

SUMMARY OF THE INVENTION

In accordance with the foregoing objects, the present invention—a recreational amusement—generally comprises an otherwise conventional food and beverage cooler having a toss-type game board integrated with the lid thereof. The toss-type game board generally includes one or more cavities provided in the top of the lid of the cooler. Additionally, provision is made in the recreational amusement of the present invention for orienting the top of the lid in a sloping position for play of the game enabled by the game board.

Many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Figure 1:
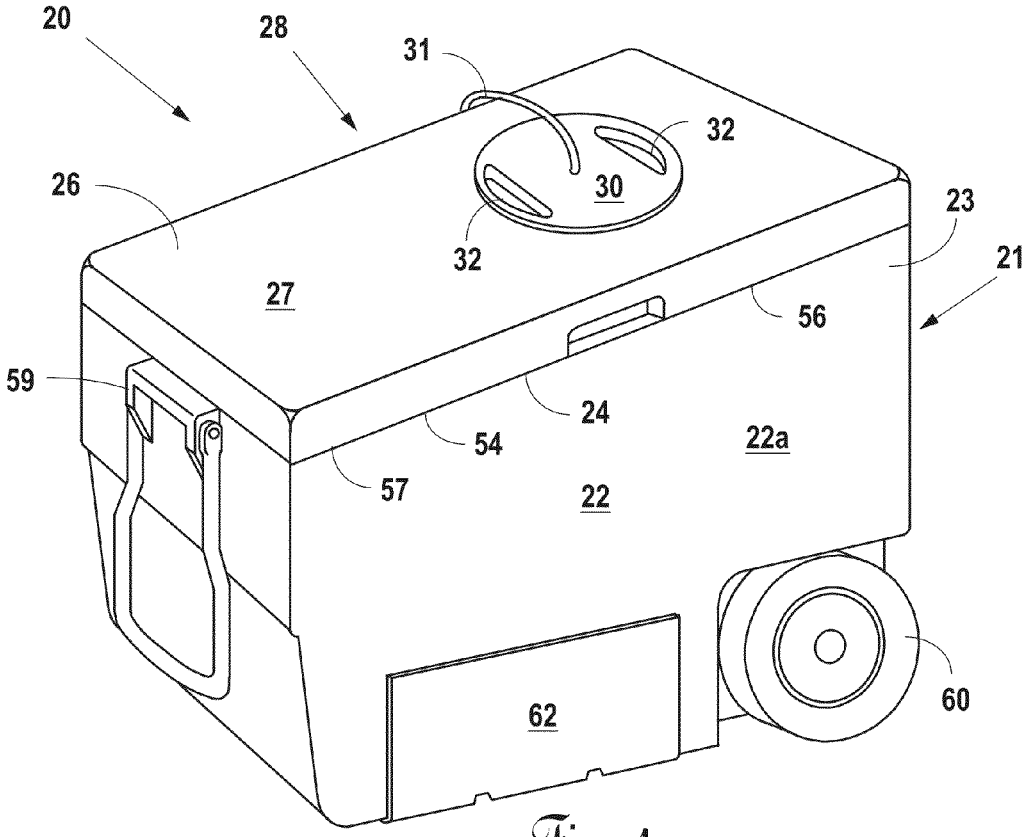
FIG. 1 shows, in a perspective view, a first preferred embodiment of the recreational amusement of the present invention.

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures, the recreational amusement 20 of the present invention generally comprises an otherwise conventional food and beverage cooler 21 having a toss-type game board 28 integrated with the lid 26 thereof. As clearly shown in figures, and in FIGS. 1, 2, 3, 5, 6, 7A, 11, 12, 16, 18 and 31 in particular, and as is also well known to those of ordinary skill in the art to be the hallmark of a "cooler," the lid 26 for such a conventional cooler 21 is adapted for mating engagement with the body 22 of the cooler 21 such that when the lid 26 is in place atop the body 26 the interior space of the cooler 21 is substantially sealed off from the environment about the cooler 21. Without compromise of the fundamental characteristics of a cooler, however, the toss-type game board 28 generally comprises one or more cavities 29 provided in the top 27 of the lid 26 of the cooler 21. Additionally, provision is made in the recreational amusement 20 of the present invention for orienting the top 27 of the lid 26 in a sloping position for play of the game enabled by the game board 28.

Figure 2:
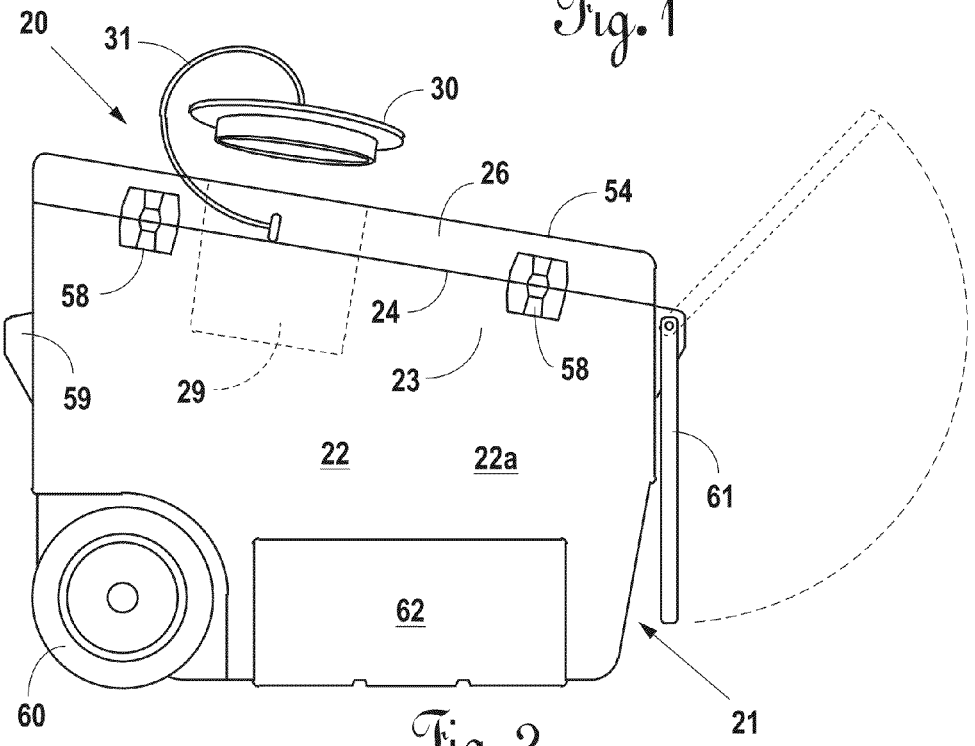
FIG. 2 shows, in a left side elevational view, the recreational amusement of FIG. 1.
Figure 3:
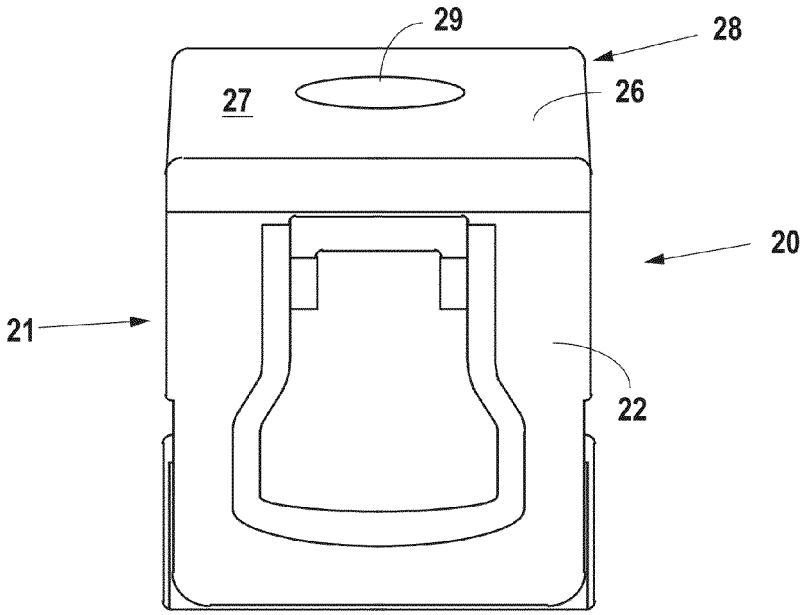
FIG. 3 shows, in a front end view, the recreational amusement of FIG. 1.
Figure 4:
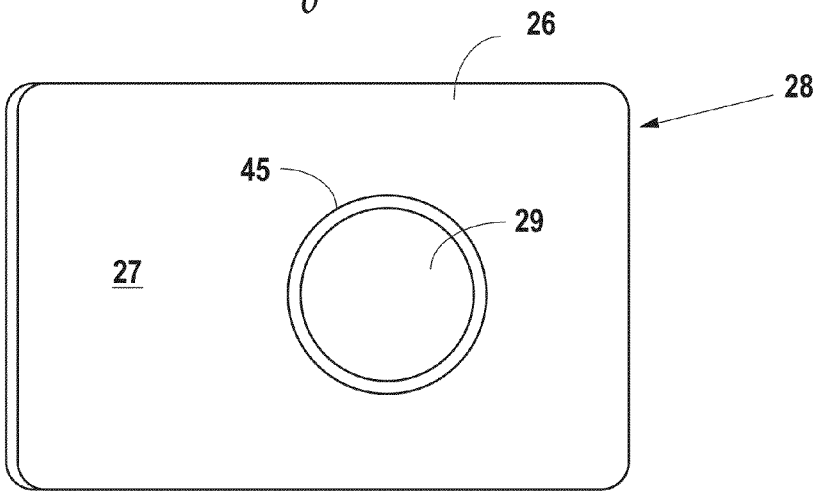
FIG. 4 shows, in a top plan view, the lid of the cooler embodying the recreational amusement of FIG. 1.
Figure 5:
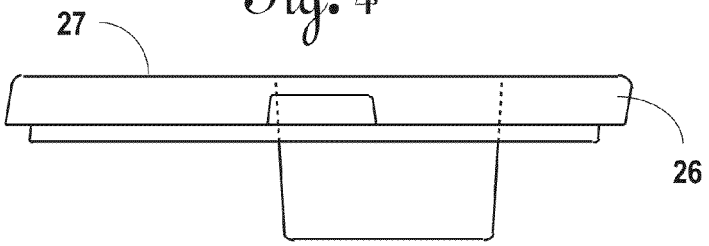
FIG. 5 shows, in right side elevational view, the lid of FIG. 4.
Figure 6:
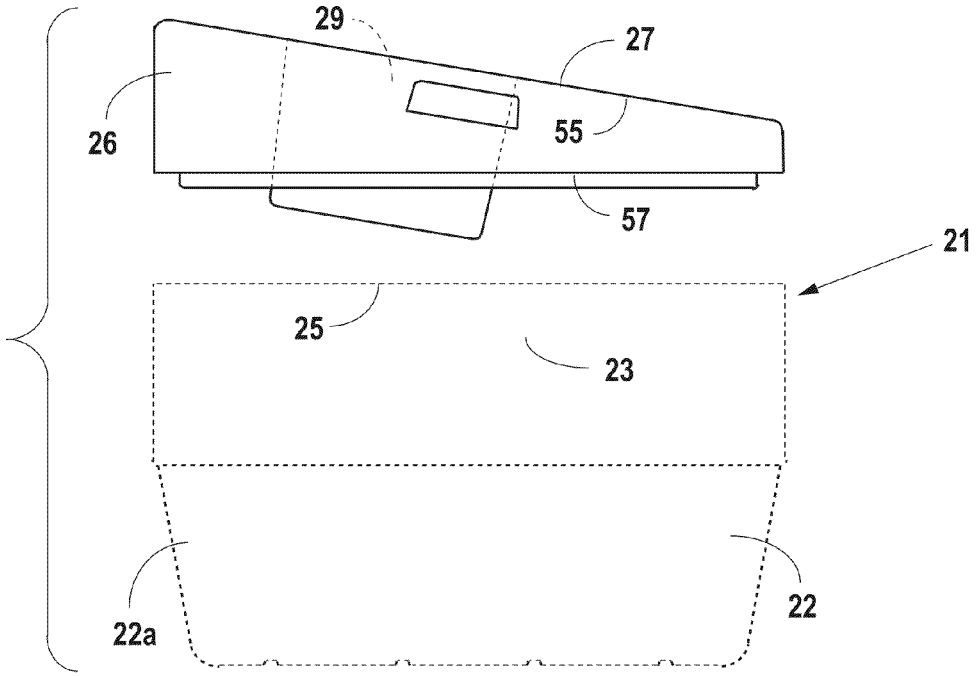
FIG. 6 shows, in a left side elevational view, the lid of a cooler as formed to implement a second preferred embodiment of the recreational amusement of the present invention.
Figure 7:
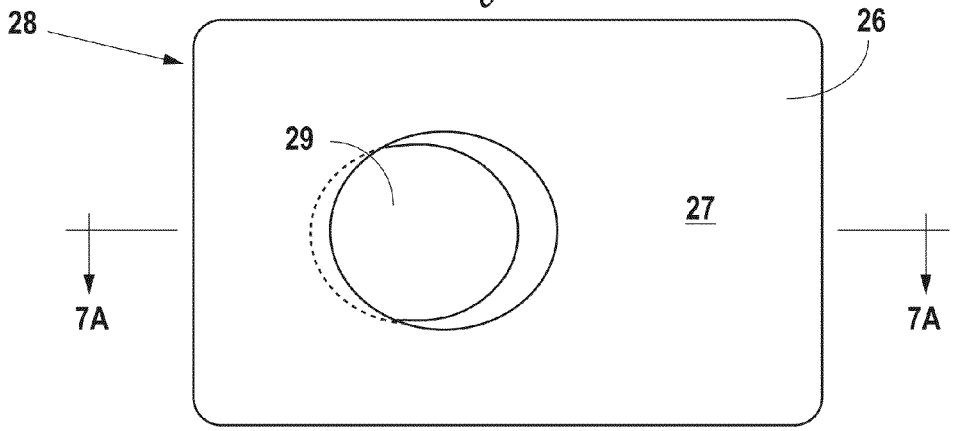
FIG. 7 shows, in a top plan view, the lid of FIG. 6.
Figure 7A:
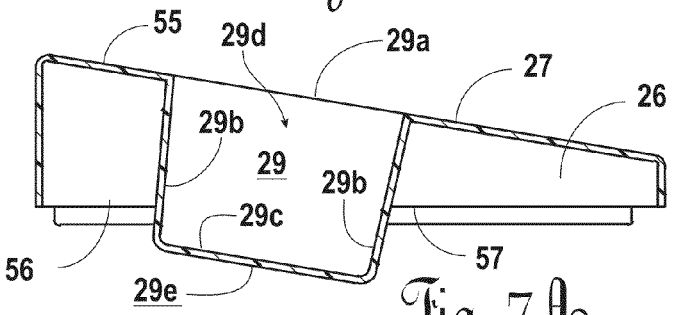
FIG. 7A shows, in a cross-sectional view taken through cut line 7A-7A of FIG. 7, the lid of FIG. 6.

In a first preferred embodiment of the recreational amusement 20, as particularly shown in FIGS. 1 and 2, the sloping aspect of the top 27 of the lid 26 for the cooler 21 may be provided by forming the top portion 23 of a box 22*a* forming the body 22 of the cooler 21 to have a sloping edge profile 24. In this embodiment, the bottom 56 of the lid 27 is generally conventionally formed to have a traditional horizontal edge profile 57 and the top 28 of the lid 27 is also formed to have a traditional edge profile 24. In a second preferred embodiment of the recreational amusement 20, as particularly shown in FIGS. 6 and 7, the lid 26 for the cooler 21 may be formed with a traditional horizontal edge profile 57 at the bottom 56 thereof but with a sloping horizontal edge profile 55 at the top 27. As will be appreciated by those of ordinary skill in the art, especially in light of this exemplary detailed description, this second preferred embodiment of the recreational amusement 20 is particularly suited for enabling implementation of the present invention in the after-market for conventional coolers, wherein it is to be expected that the box 22*a* of the body 22 of the cooler 21 would have a traditional horizontal edge profile 25 at the top 23 thereof.

Figure 17:
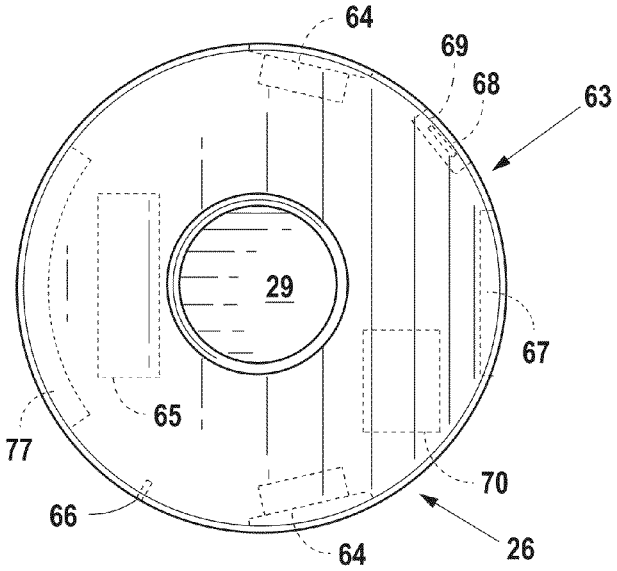
FIG. 17 shows, in a top plan view, the lid of the cooler embodying the recreational amusement of FIG. 16.
Figure 18:
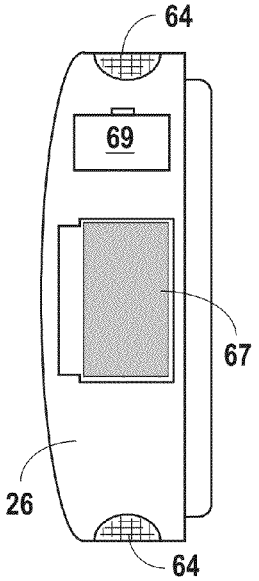
FIG. 18 shows, in a rear end view, the lid of FIG. 17.
Figure 16:
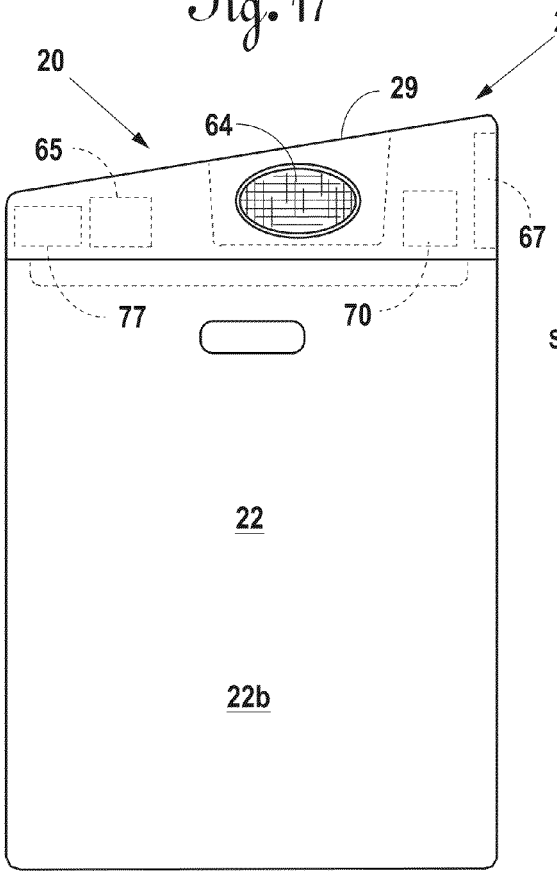
FIG. 16 shows, in a right side elevational view, a third preferred embodiment of the recreational amusement of the present invention.
Figure 19:
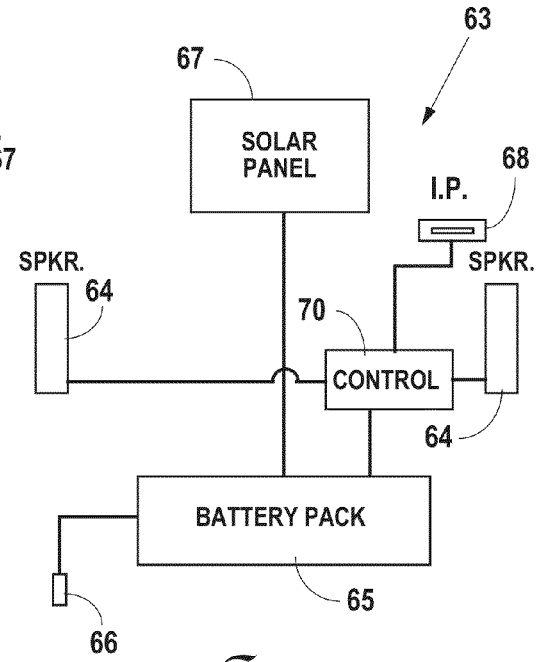
FIG. 19 shows, in a schematic block diagram, details of an eight extension of various aspects of the recreational amusement of FIG. 1, 6 or 16.
Figure 20:
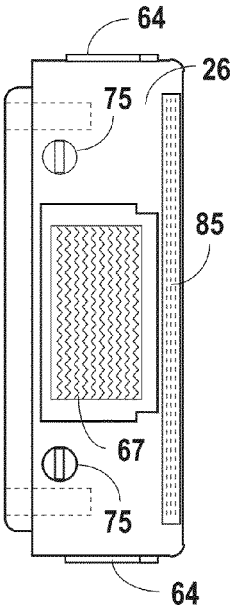
FIG. 20 shows, in a rear end view, details of a ninth extension of various aspects of the recreational amusement of the present invention.

As particularly shown in FIGS. 16 and 17, however, it is additionally noted that the body 22 of the cooler 21 is not limited to taking the form of a box 22*a* as previously discussed. As shown in FIGS. 16 and 17, the body of the cooler 21 may take the form of a jug 22*b* or may comprise any other substantially equivalent container base, the only critical aspect of the present invention being that provision is made in the recreational amusement 20 of the present invention for orienting the top 27 of the lid 26 in a sloping position for play of the game enabled by the game board 28 while the lid 26 of the cooler 21 is in place atop and in substantially sealing engagement with the body 22 of the cooler 21 consistent with and without compromise of the well known hallmark characteristic of otherwise conventional food and beverage coolers.

Regardless of implementation for the sloping aspect of the game board 28, the one or more cavities 29 are disposed in the lid 26 for a cooler 21, thereby forming in the top 27 of the lid 26 one or more repositories for receiving therein a ball, toss-bag or the like in play of the enabled game. As clearly shown throughout the various figures, but most particularly in FIG. 7A, each provided cavity 29 forming a repository for a game piece is formed such that the rim 29*a* about the top of the cavity 29 is flush with the top 27 of the lid 26 of the cooler 21. Additionally, and as also clearly shown throughout the various figures, each provided cavity 29 is formed such that the wall or walls 29*b* thereof terminate in a closed bottom 29*c* of the cavity 29 such that the interior space 29*d* of the cavity 29 forms a repository for a game piece isolated from the interior space of the body 22 of the cooler 21 such as is conventionally used for the containment of food and/or beverages. If desired or necessary in a particular implementation, however, the structure forming a cavity 29 may extend through the lid 26 for a cooler 21 such that some of the exterior surfaces 29*e* of the cavity may project at least some distance below the bottom 56 of the lid 26 of the cooler 21 and into the interior space of the body 22 of the cooler 21.

In any case, as will be appreciated by those of ordinary skill in the art, especially in light of the accompanying drawings and this exemplary description, a cavity 29 implemented as described in the lid 26 of a cooler 21 is particularly adapted to form a repository for receiving therein a ball, toss-bag or the like in play of an enabled game while ensuring that provision of such a cavity does not compromise the hallmark characteristic of a otherwise conventional "cooler" that the lid 26 for such a conventional cooler 21 be adapted for mating engagement with the body 22 of the cooler 21 such that when the lid 26 is in place atop the body 26 the interior space of the cooler 21 is substantially sealed off from the environment about the cooler 21. To that end, the term "a cavity formed in a top surface of a lid of a cooler," including language of similar import such as, for example, "a cavity formed in said top surface of said lid," is as used herein hereby expressly defined to mean a cavity comprising a wall or walls extending downward from a rim flush with the top surface of the lid of the cooler and terminating in a closed bottom such that the cavity so defined forms a receptacle having an interior space accessible only from the top side of the lid.

As shown in FIGS. 1 and 2, such a cavity 29 may be provided with a lid 30, which is preferably provided with a tether 31 for retaining the lid 30 during play of the game and/or one or more handles 32 for facilitating removal of the lid 30 as desired. As will be appreciated by those of ordinary skill in the art, provision of such a lid 30 increases the utility of the present invention by enabling the game cavities 29 to also serve as storage areas for condiments, picnic supplies or the like.

Figure 8:
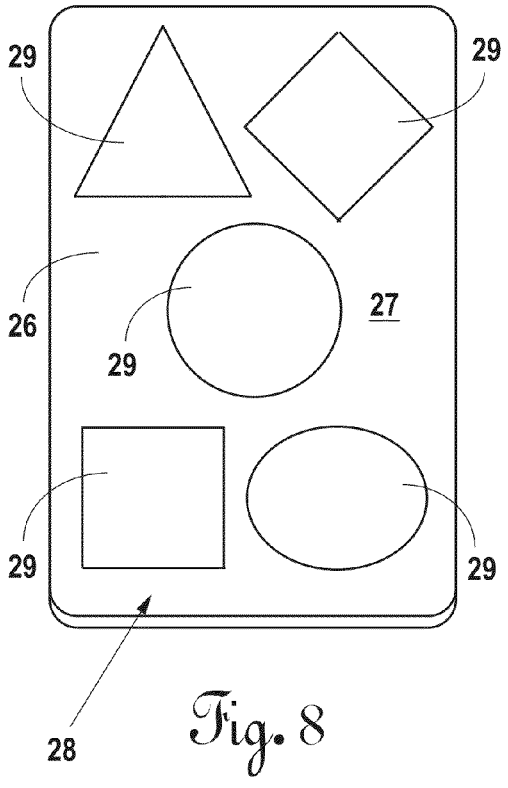
FIG. 8 shows, in a top plan view generally corresponding to the view of FIG. 4, a first extension of various aspects of the recreational amusement of FIG. 1 or 6.
Figure 9:
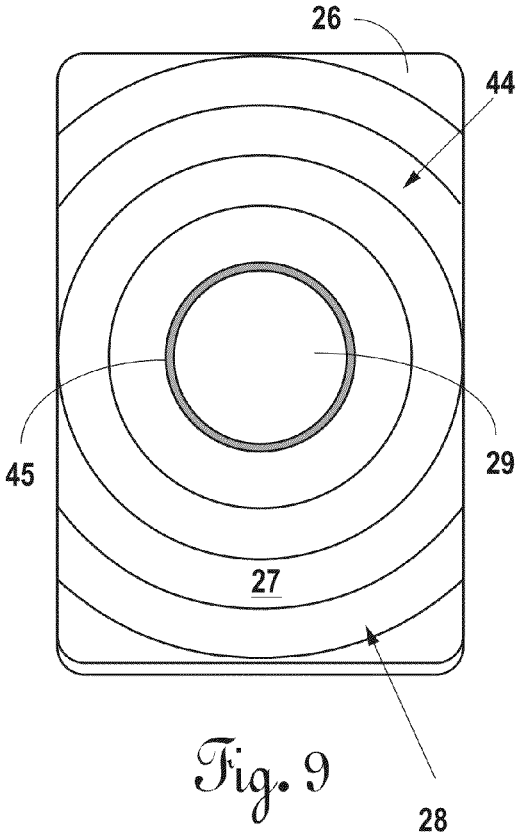
FIG. 9 shows, in a top plan view generally corresponding to the view of FIG. 4, a second extension of various aspects of the recreational amusement of FIG. 1 or 6.
Figure 10:
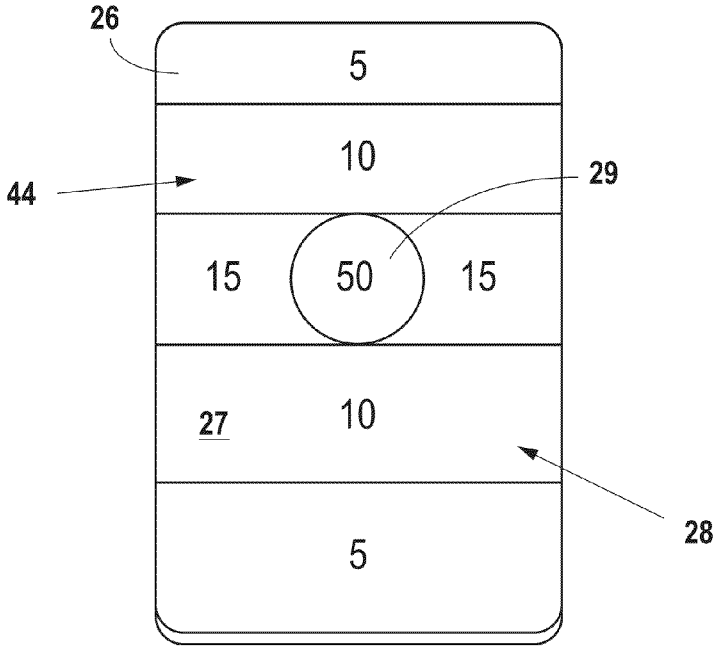
FIG. 10 shows, in a top plan view generally corresponding to the view of FIG. 4, a third extension of various aspects of the recreational amusement of FIG. 1 or 6.

As particularly shown in FIGS. 8 through 10, the game board 28 may be implemented in a variety of alternative forms. For example, as shown in FIG. 8, a plurality of cavities 29 may be provided in top 27 of the lid 26. As also shown in FIG. 8, the cavities may take a variety of shapes and be of a variety of sizes, thereby increasing the possibilities for play and scoring of the game. Additionally, as particularly shown in FIGS. 9 and 10, scoring appliqué 44 may be provided to further enhance the game. As particularly shown in FIG. 9, one or more of the scoring appliqué 44 may be manufactured of luminescent material 45 for play of the game in poorly lighted areas.

Figure 13:
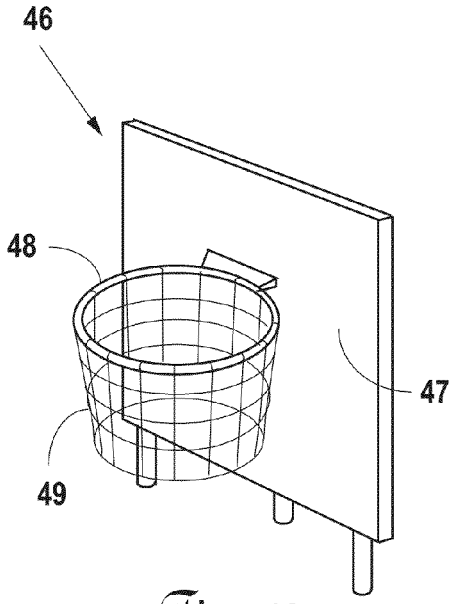
FIG. 13 shows, in a perspective view, an alternative embodiment of the extension of FIG. 12.
Figure 12A:
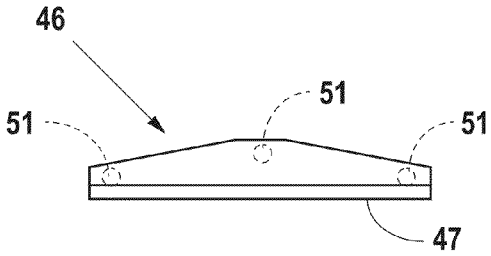
FIG. 12A shows, in a top plan view, details of the extension of FIG. 12.
Figure 12:
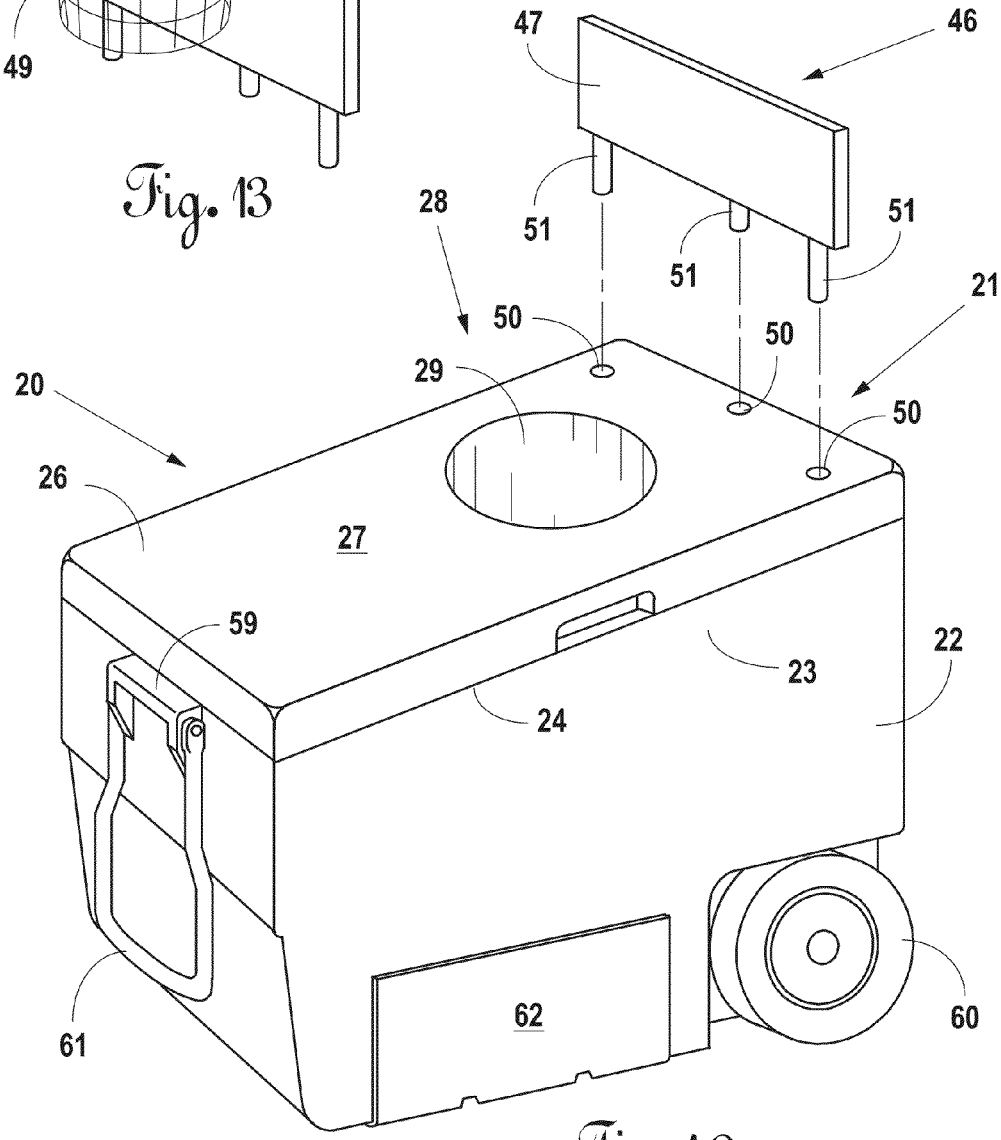
FIG. 12 shows, in a perspective view generally corresponding to the view of FIG. 1, a fifth extension of various aspects of the recreational amusement of FIG. 1 or 6.
Figure 32:
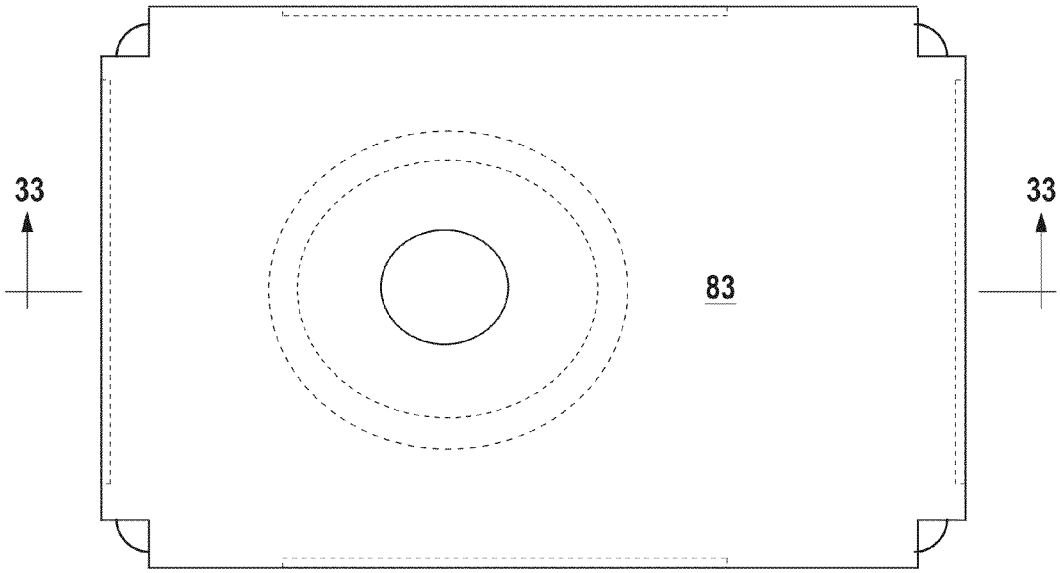
FIG. 32 shows, in a top plan view, details of a twelfth extension of various aspects of the present invention.
Figure 33:
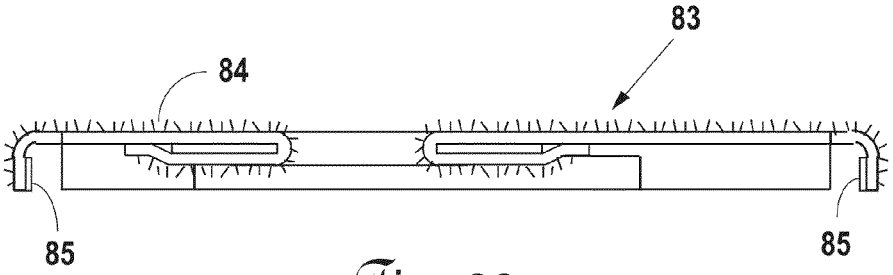
FIG. 33 shows, in a side cross sectional view taken through line 33-33 of FIG. 32, additional details of the extension of FIG. 32.

As particularly shown in FIGS. 12 and 13, a plurality of attachments 46 may be provided as part of the recreational amusement 20 of the present invention, thereby injecting further variety into play of the game. For example, a backboard 47 may be provided as particularly shown in FIG. 12. As shown in FIG. 12, such a backboard 47 is preferably provided with one or more attachment mounting pegs 51 which may be received in a corresponding number of attachment mounting holes 50 provided in the top 27 of the lid 26. As particularly shown in FIG. 12A, such mounting holes 50 and corresponding attachment mounting pegs 51 are preferably provided in a non-linear layout in order to give additional vertical stability to the backboard 47 thereby preventing inadvertent dislodgement of the backboard 47 upon impact from a ball, toss bag or the like. As particularly shown in FIG. 13, an attachment 46 comprising a backboard 47 may be provided with a ring 48, which may have a net 49 or the like attached thereto, thereby extending the game implemented in the recreational amusement 20 of the present invention to a basketball-like game. Similarly, as particularly shown in FIG. 31, such an attachment 46 may also comprise a ladder-type structure 82 for play of another popular game or other similar structure. As shown in FIGS. 32 and 33, an overlay 83 may be provided such that the lid 26 of the present invention may be better suited to the play of "washers" or other coin-toss type games. In such a case, the overlay 83 may be provided with a surface of artificial grass 84 and/or hook-and-loop type fastener material 85 for affixation to the lid 26. Although not shown in the drawings, those of ordinary skill in the art will recognize that such artificial grass material, rubber or neoprene or like surface may be provided interior to the cavity 29 or cavities 29 in the lid also as an aid in the play of such games.

Figure 11:
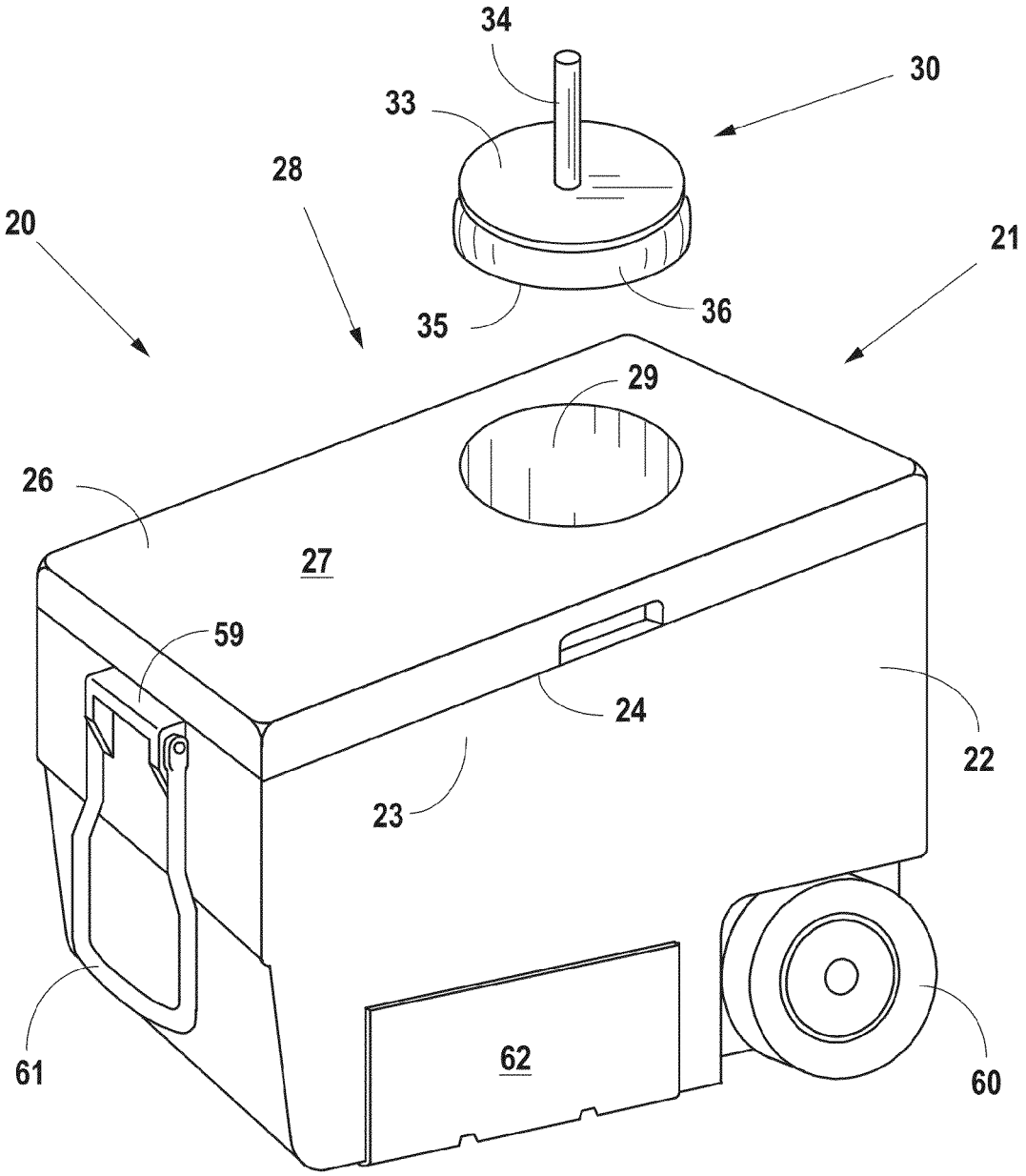
FIG. 11 shows, in a perspective view generally corresponding to the view of FIG. 1, a fourth extension of various aspects of the recreational amusement of FIG. 1 or 6.

The utility of the recreational amusement 20 of the present invention may also be extended by providing the cavity 29 with a reversible-lid 30 as shown in FIG. 11. In this implementation, the top 33 of the lid 30 is provided with a peg 34 attached thereto. The base 35 of the lid 30 is also preferably provided with a frictional edge banding 36, thereby forming the lid 30 as a plug for insertion into the cavity 29. As will be appreciated by those of ordinary skill in the art, this implementation allows the toss-type game to be played as a ring-toss type game. As will also be appreciated by those of ordinary in the art, such a lid 30 may simply be inverted for transportation or storage of the recreational amusement 20 with the peg 34 contained fully within the cavity 29.

Figure 14:
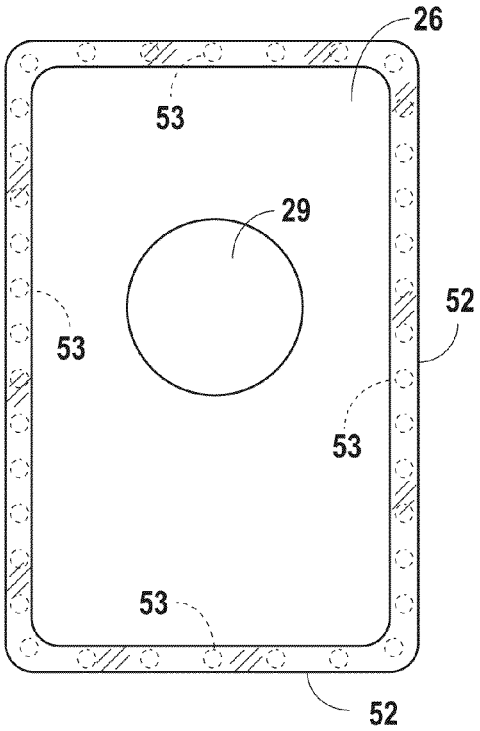
FIG. 14 shows, in a top plan view generally corresponding to the view of FIG. 4, a sixth extension of various aspects of the recreational amusement of FIG. 1 or 6.
Figure 15:
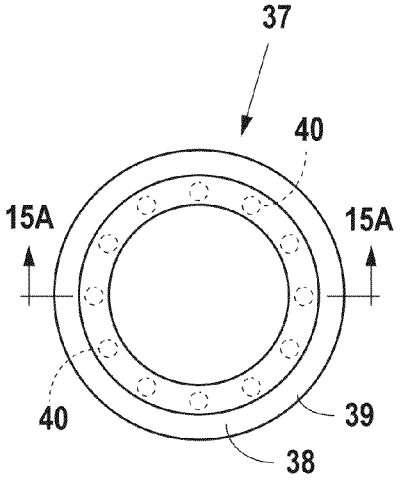
FIG. 15 shows, in a top plan view, a seventh extension of various aspects of the recreational amusement of FIG. 1 or 6.
Figure 15A:
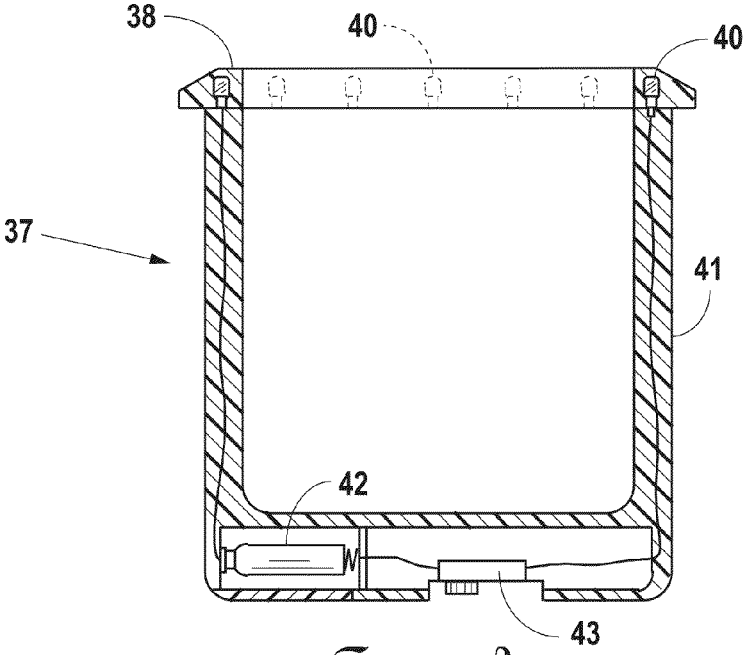
FIG. 15A shows, in a cross sectional view taken through cut line 15A-15A of FIG. 15, details of the extension of FIG. 15.
Figure 34:
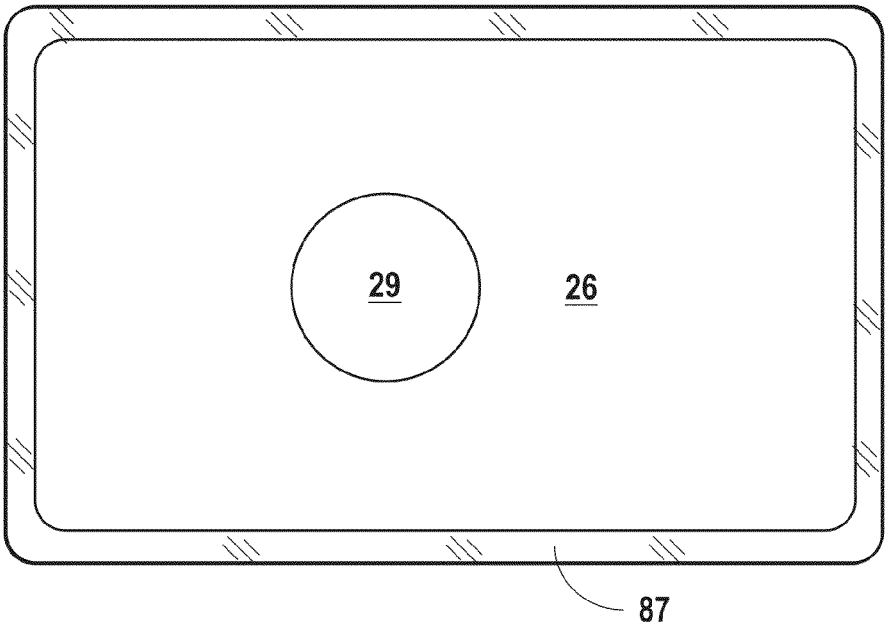
FIG. 34 shows, in a top plan view, details of a thirteenth extension of the present invention as implemented in conjunction with a cooler as shown in FIG. 1 or 6.
Figure 35:
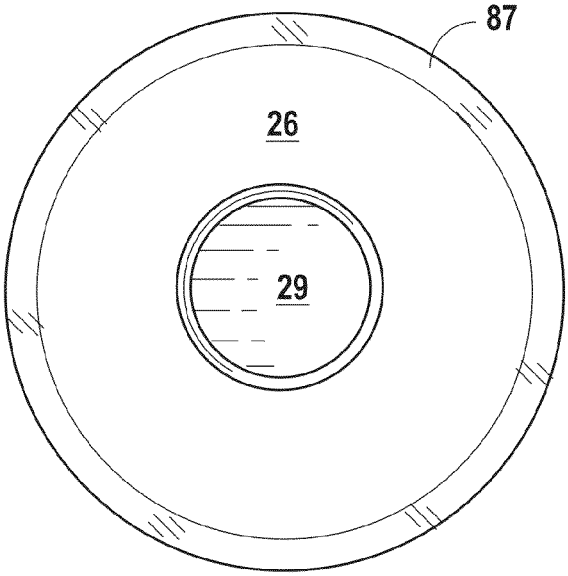
FIG. 35 shows, in a top plan view, details of the extension of FIG. 34 as implemented in conjunction with a cooler as shown in FIG. 16.

As particularly shown in FIG. 14, the lid 26 for the cooler 21 may be provided with preferably embedded lighting 53 about the perimeter 52 thereof. In this manner, the recreational amusement 20 of the present invention may be readily played even in very low lighting conditions. In a further extension of the present invention, the recreational amusement 20 may be provided with an insert 37 for the cavity 29. In this manner, embedded lighting 40 may be optionally provided about the cavity 29. In implementation of such an extension, the embedded lighting 40 is provided about the perimeter 39 of the top 38 of the insert and a power source 42 for the lighting 40 as well as an ON-OFF switch 43 are provided in the base 41 of the insert 37. As will be appreciated by those of ordinary skill in the art, by implementing this extension of the present invention as an insert 37, the lighting power source 42 and switch 43 are easily provided in an out-of-the-way location, thereby preventing interference with play of the game. In a simpler implementation of this general aspect of the present invention, reflective or "glow-in-the-dark" appliqué 87 may be provided about the lid 26 as particularly exemplified in FIGS. 34 and 35.

Figure 25:
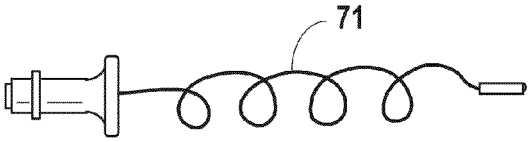
FIG. 25 shows, an electrical cord and plug assembly as may be utilized in conjunction with various embodiments of the present invention.

As shown in various figures, and particularly in FIGS. 16, 17, 18, 19, 20, 21 and 22, an integrated speaker system 63 may be provided with any embodiment of the present invention, thereby enabling the use of a portable audio device in conjunction with the other recreational uses of the present invention. As shown in the figures, such an integrated speaker system 63 may include one or more audio speakers 64, a battery pack 65 and an interface port 68 for connection of a portable audio device. The battery pack 65 may include and external charging port 66 or, alternatively or in combination, such a port 66 may be utilized to supply power from the battery pack to small electronic devices such as, for example, a cellular telephone. As will be appreciated by those of ordinary skill in the art, an appropriate power cord 71, such as depicted in FIG. 25, may be provided. Additionally, the integrated speaker system 63 may comprise one or more solar panel 67, which are preferably hingedly attached to the side of the lid 26 generally protected from the throwing of balls, bean bags or the like. As will be appreciated by those of ordinary skill in the art in light of this exemplary disclosure, an appropriate control circuit 70 may accompany the integrated speaker system 63 and the portable audio device may be protected from weather and play of games by enclosure within a hatch 69, which hatch 69 may be made watertight.

Figure 21:
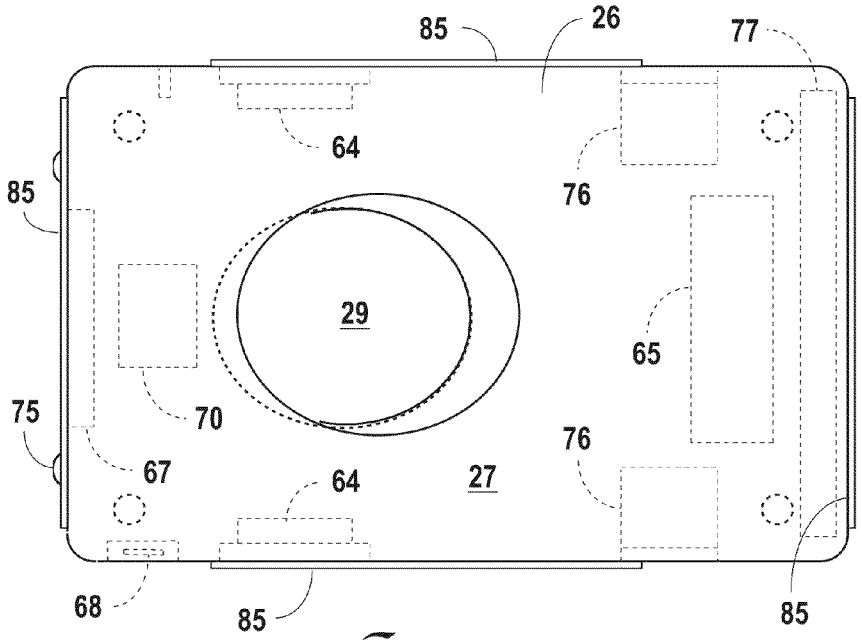
FIG. 21 shows, in a top plan view, further details of the embodiment of FIG. 20.

For play of the implemented game in a pool or other body of water, the lid 26 of the cooler 21 may be fully removable from the body 22 and, if necessary or desired, may be provided with internal ballast 77, as shown in FIGS. 17 and 21, to promote stability and/or balance of the floating lid 26. In the case of implementations wherein the lid 26 is fully removable, removable legs 72 or folding legs 86 or the like may be provided, as particular shown in FIGS. 20, 21, 22, 23, 24, 27, 28, 29 and 30. In the case of removable legs 72, one or more storage compartments 74, which may comprise caps 75, may be provided for convenient storage. As will be appreciated by those of ordinary skill in the art, such removable legs 72 may be frictionally engaged with the lid 26 or may be provided with appropriate threading 73 or the like.

It should be noted that Applicant contemplates that in at least one embodiment of the recreational amusement 20 of the present invention, the combination comprises one lid 26 having no legs, which first lid is meant to remain in place atop the cooler body 22, and an additional lid 26 provided with legs, which second lid is easily transported with the recreational amusement 20 by affixation in an upside down position atop the first lid by any conventional means. Upon reaching a recreational destination, the second lid may be separated from the first, enabling the game of choice to be played in back-and-forth fashion.

Figure 22:
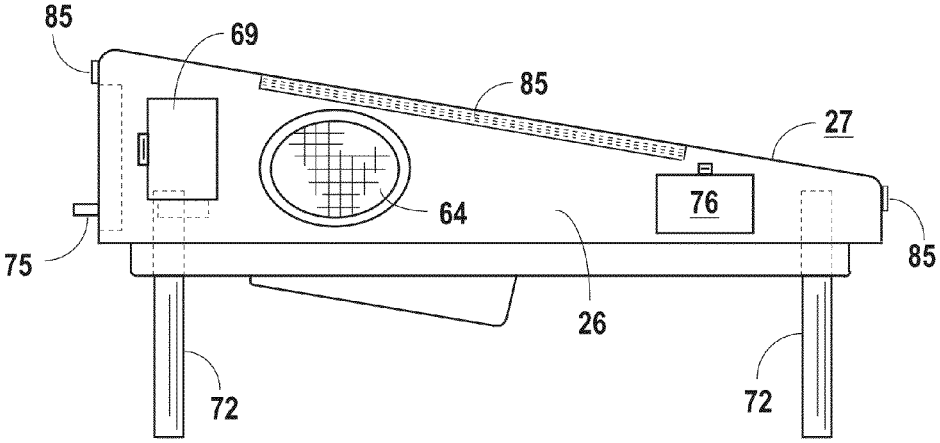
FIG. 22 shows, in a left side elevational view, still further details of the embodiment of FIG. 20.
Figure 23:
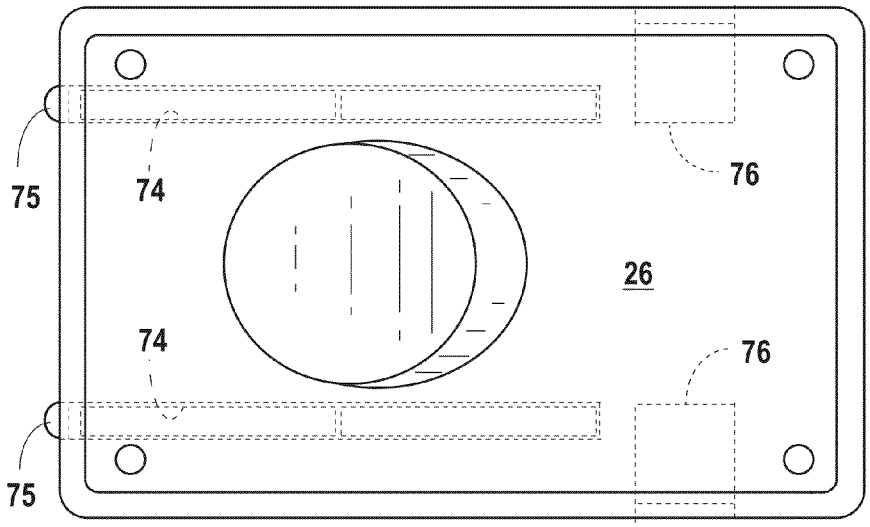
FIG. 23 shows, in a bottom plan view, still further yet details of the embodiment of FIG. 20.
Figure 24:
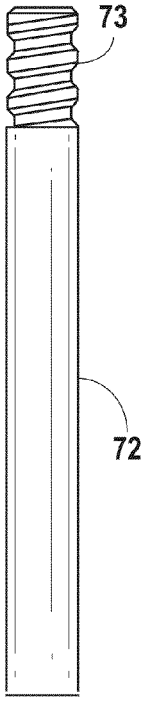
FIG. 24 shows, in an elevational view, details of a detachable leg as may be utilized with the embodiment of FIG. 20.
Figure 26:
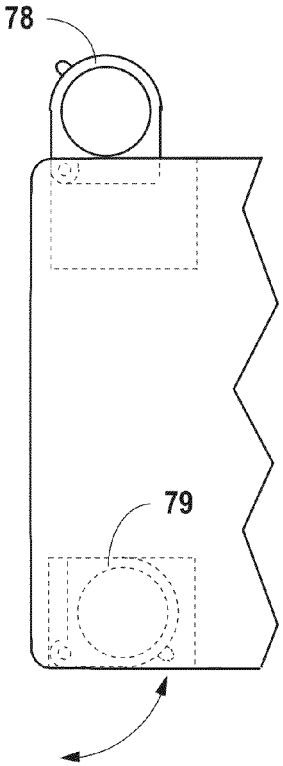
FIG. 26 shows, in a partially cutaway top view, details of a tenth extension of various aspects of the present invention.
Figure 27:
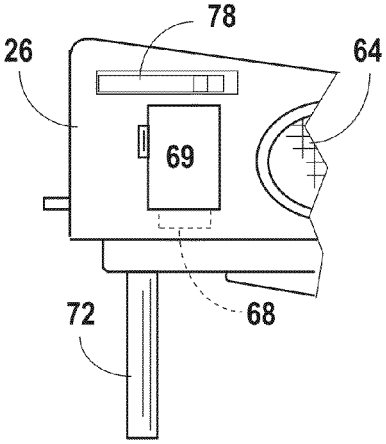
FIG. 27 shows, in a partially cutaway left side elevational view, additional details of the extension of FIG. 26.
Figure 28:
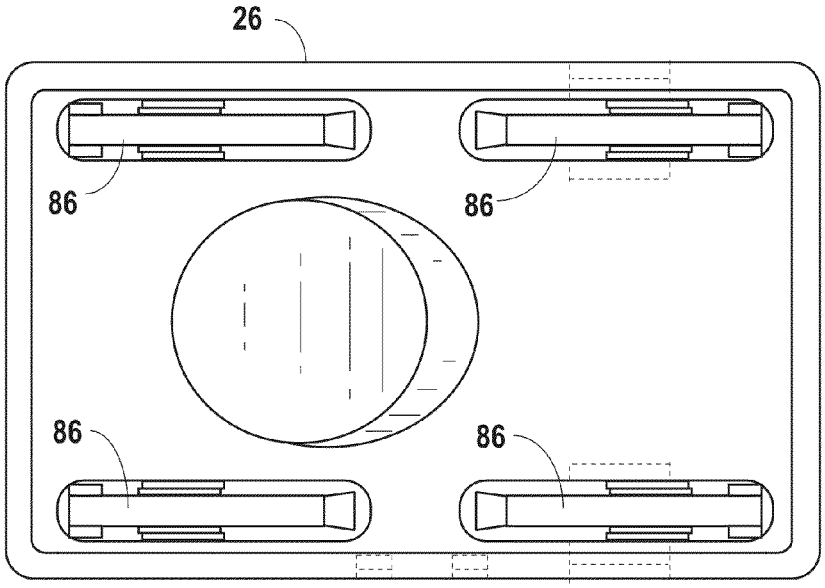
FIG. 28 shows, in a bottom plan view, an alternate embodiment of certain details of FIG. 23.
Figure 30:
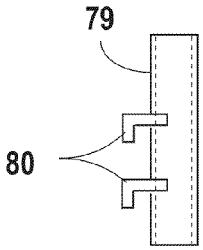
FIG. 30 shows, in an elevational view, an eleventh extension of various aspects of the present invention.
Figure 29:
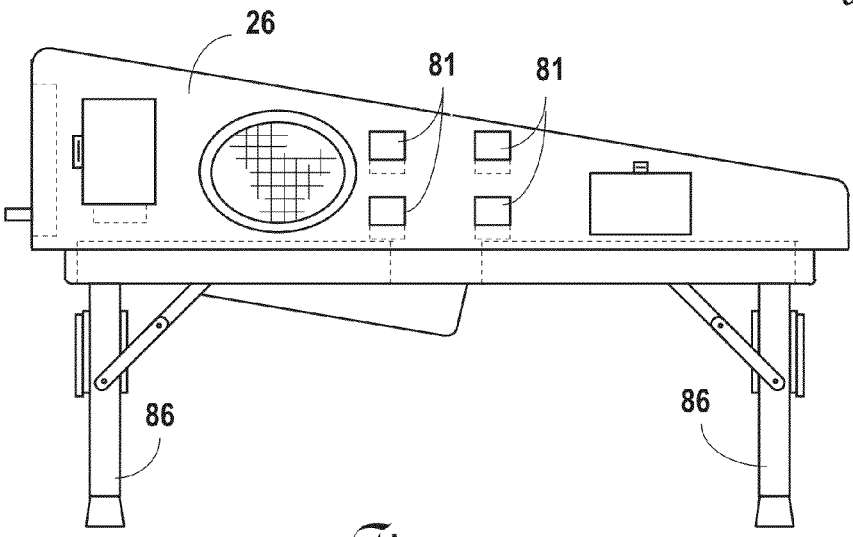
FIG. 29 shows, in a left side elevational view, additional details of the alternate embodiment of FIG. 28.
Figure 31:
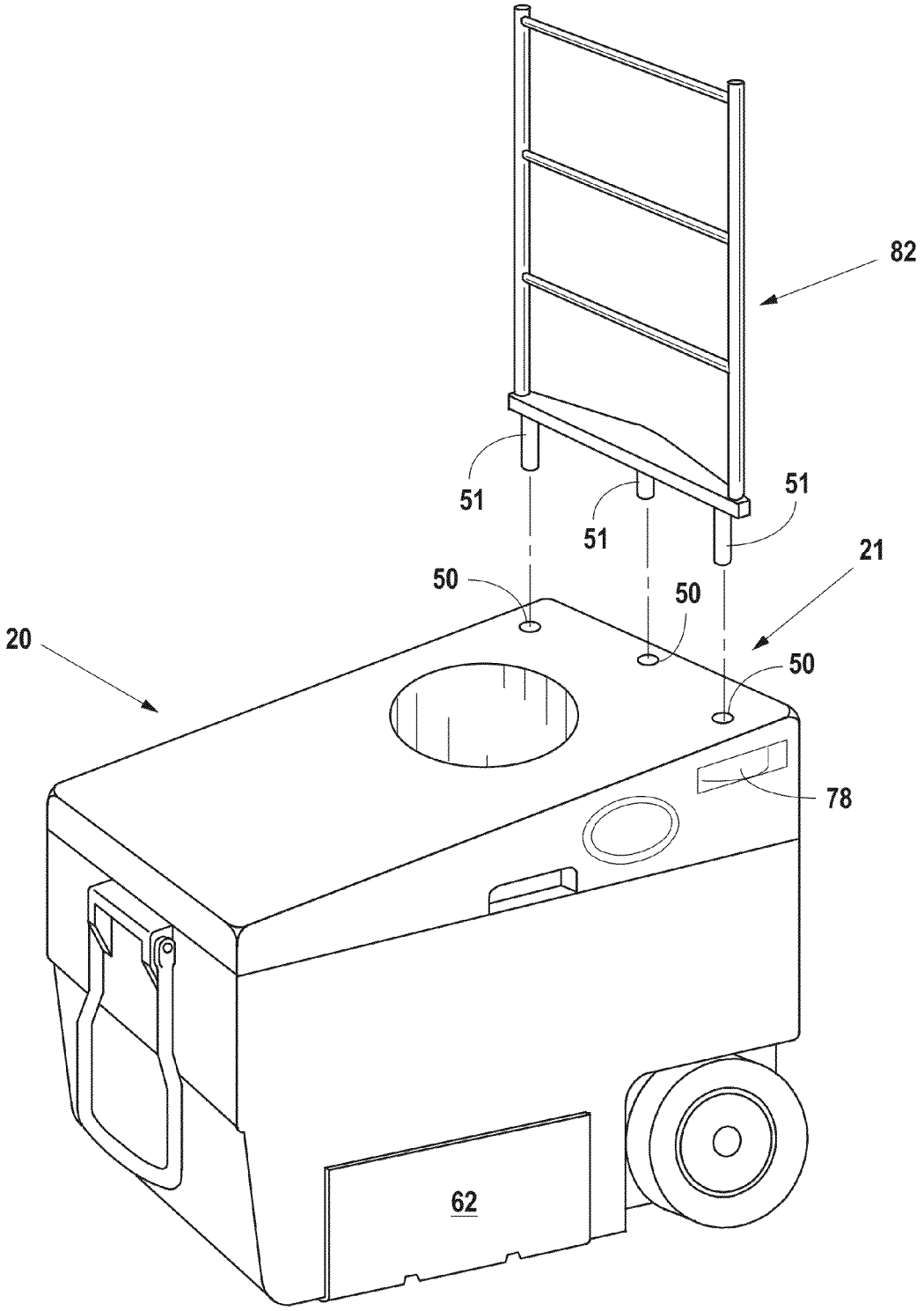
FIG. 31 shows, in a perspective view, a variation of the extensions of the present invention generally depicted in FIGS. 12, 12A and 13.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and the claims drawn hereto. For example, it is to be expected that the cooler 21 may be provided with any conventional features such as carrying handles 59 wheels 60, a hingedly attached pulling handle 61 or protective reinforcement 62. Likewise, in implementations comprising an integrated lid 26, the lid 26 may be provided with conventional hinges 28. Still further, one or more general storage compartments 76, which compartments 76 may be made watertight, are preferably provided in the available interior space of the lid 26 as shown in FIGS. 21, 22 and 23. Still further yet, virtually any embodiment of the recreational amusement 20 may be provided with retractable beverage holders 78, such as are shown in FIGS. 26 and 27, fishing rod holders 79, such as are shown in FIGS. 29 and 30, or the like. In such extensions, it should be noted that the exemplary depictions shown are not intended to be limiting. For example, the hook 80 and slot 81 arrangement of the depicted fishing rod holder 79 may be equally utilized for attachment of a beverage holder. To this end, it is emphasized that it is expressly contemplated that any or all of the variously described extensions of the present invention may be combined in whole or in part in any basic configuration of the recreational amusement 20 of the present invention, each of which is considered to be within the scope of the present invention. In any case, because the scope of the present invention is much broader than any particular embodiment, the foregoing detailed description should not be construed as a limitation of the present invention, which is limited only by the claims appended hereto.

What is claimed is:

1. A cooler lid for use in connection with a cooler body having an interior space and a top edge about the interior space and wherein the top edge of the cooler body is characterized by a horizontal side profile, said cooler lid comprising:

a top surface and a bottom surface;

a game board formed in said top surface; and wherein:

said cooler lid is adapted to sealingly mate with the cooler body;

said top surface comprises a sloping side profile when said cooler lid is mated in place on the cooler body;

said bottom surface comprises a horizontal side profile when said cooler lid is mated in place on the cooler body; and said game board comprises a cavity formed in said top surface, said cavity having a walled interior space terminating in a closed bottom such that said interior space of said cavity is isolated from the interior space of the cooler body when said cooler lid is mated in place on the cooler body.

2. The cooler lid as recited in claim 1, wherein said game board further comprises a selectively removable attachment.

3. The cooler lid as recited in claim 2, wherein said selectively removable attachment comprises a backboard.

4. The cooler lid as recited in claim 3, wherein said selectively removable attachment further comprises a ring affixed to said backboard.

5. The cooler lid as recited in claim 4, wherein said selectively removable attachment further comprises a net affixed to said ring.

6. The cooler lid as recited in claim 2, wherein said selectively removable attachment comprises a ladder.

7. The cooler lid as recited in claim 2, wherein:

said selectively removable attachment is dependently supported atop a plurality of mounting pegs; and said top surface comprises a plurality of mounting holes arranged to receive therein one each of said mounting pegs.

8. The cooler lid as recited in claim 2, wherein said selectively removable attachment comprises a plug adapted to form a lid for said cavity.

9. The cooler lid as recited in claim 8, wherein said plug comprises a peg attached to one side thereof.

10. The cooler lid as recited in claim 1, wherein said game board further comprises a scoring appliqué formed in said top surface.

11. The cooler lid as recited in claim 10, wherein said scoring appliqué comprises a luminescent material.

12. The cooler lid as recited in claim 1, said cooler lid further comprising integral lighting.

13. The cooler lid as recited in claim 12, wherein said integral lighting is provided about the perimeter of said top surface.

14. The cooler lid as recited in claim 12, wherein said integral lighting is provided about the perimeter of said cavity.

15. The cooler lid as recited in claim 1, said cooler lid being adapted to float in water.

16. The cooler lid as recited in claim 15, said cooler lid further comprising ballast.

17. The cooler lid as recited in claim 1, said cooler lid further comprising a plurality of selectively deployable legs.

18. The cooler lid as recited in claim 17, wherein said selectively deployable legs are removably affixed to said bottom surface.

19. The cooler lid as recited in claim 17, wherein said selectively deployable legs are hingedly affixed to said bottom surface.

20. A cooler lid for use in connection with a cooler body having an interior space and a top edge about the interior space and wherein the top edge of the cooler body is characterized by a sloping side profile, said cooler lid comprising:

a top surface and a bottom surface;

a game board formed in said top surface; and wherein:

said cooler lid is adapted to sealingly mate with the cooler body;

said top surface comprises a sloping side profile when said cooler lid is mated in place on the cooler body;

said bottom surface comprises a sloping side profile when said cooler lid is mated in place on the cooler body; and said game board comprises a cavity formed in said top surface, said cavity having a walled interior space terminating in a closed bottom such that said interior space of said cavity is isolated from the interior space of the cooler body when said cooler lid is mated in place on the cooler body.

21. A recreational amusement, said recreational amusement comprising:

a cooler, said cooler comprising a body and a lid, said body having an interior space and said lid having a top surface and a bottom surface and being adapted to sealingly mate with said body;

a game board formed in said top surface of said lid; and wherein:

said body comprises a top edge, said top edge of said body comprising a horizontal side profile;

said top surface of said lid comprises a sloping side profile when said lid is positioned in place on said body;

said bottom surface of said lid comprises a horizontal side profile when said lid is positioned in place on said body; and said game board comprises:

a cavity formed in said top surface of said lid, said cavity having a walled interior space terminating in a closed bottom such that said interior space of said cavity is isolated from said interior space of said body when said lid is positioned in place on said body; and a selectively removable attachment, said selectively removable attachment comprising an article selected from the group consisting of:

a backboard, said backboard having a ring affixed thereto;

a ladder; and a plug adapted to form a lid for said cavity, said plug having a peg attached to one side thereof.

* * * * *